US007380515B1

(12) United States Patent
Church

(10) Patent No.: US 7,380,515 B1
(45) Date of Patent: Jun. 3, 2008

(54) ANTI-CAVITATION SYSTEM

(76) Inventor: Clyde M. Church, 2422 N. Alamo Cir., Mesa, AZ (US) 85213

( * ) Notice: Subject to any disclaimer, the term of this patent is extended or adjusted under 35 U.S.C. 154(b) by 0 days.

(21) Appl. No.: 11/531,733

(22) Filed: Sep. 14, 2006

(51) Int. Cl.
*B63B 1/22* (2006.01)

(52) U.S. Cl. ..... 114/285; 114/271

(58) Field of Classification Search ..... 114/271, 114/284, 285, 286, 287; 440/57, 86
See application file for complete search history.

(56) References Cited

U.S. PATENT DOCUMENTS

| | | | | |
|---|---|---|---|---|
| 3,933,116 | A | 1/1976 | Adams et al. | 115/35 |
| 4,026,231 | A | 5/1977 | Fedorko | 114/145 A |
| 4,216,737 | A | 8/1980 | Niederste-Hollenberg et al. | 440/61 |
| 4,781,632 | A | 11/1988 | Litjens et al. | 440/66 |
| 4,896,622 | A * | 1/1990 | Thomas | 114/285 |
| 5,178,566 | A | 1/1993 | Stojkov et al. | 440/75 |
| 6,607,410 | B1 | 8/2003 | Neisen et al. | 440/57 |
| 6,902,449 | B1 | 6/2005 | Faucheux et al. | 440/57 |
| 6,971,932 | B2 | 12/2005 | Maselter | 440/83 |
| 2004/0175997 | A1 | 9/2004 | Johnson | 440/53 |
| 2006/0052014 | A1 | 3/2006 | Kobayashi | 440/53 |

FOREIGN PATENT DOCUMENTS

| | | |
|---|---|---|
| WO | WO2004/072502 | 8/2004 |

* cited by examiner

*Primary Examiner*—Lars A Olson
(74) *Attorney, Agent, or Firm*—Cahill, von Hellens & Glazer P.L.C.

(57) ABSTRACT

An anti-cavitation plate actuating system incorporates pressurized air selectively applied through a control valve to an air assist cylinder. The cylinder, when pressurized, applies force to anti-cavitation plate return springs; the force is not sufficient to expand or retract the springs but merely to apply a pre-load. A control pedal operating through a control shaft applies additional force through an actuating shaft connected through a control lever to the anti-cavitation plate to lower the plate.

10 Claims, 3 Drawing Sheets

ANTI-CAVITATION SYSTEM

BACKGROUND OF THE INVENTION

Boat racing has become a very popular sport and has resulted in greater competitiveness and increased speeds of the boats in the respective boat classes. Typically the driver applies full power to the boat drive system in an attempt to get the hull positioned with as little contact with the water as possible. In such position, there is minimum drag and the boat can attain a higher speed. If the water is ideally smooth, this boat hull attitude, with the hull slightly raised and minimum contact with the surface results in maximum sustained speed. An anti-cavitation plate is typically attached to the bottom of the hull at the stern of the boat (usually flush mounted to minimize drag) that performs the usual duties of anti-cavitation well known in the art. The anti-cavitation plate also performs the function of applying a downward force on the bow of the boat if the anti-cavitation plate is pivoted downwardly into the water. If the water surface is rough or if there are surface disturbances caused by other boats, or there are required changes in speed and direction such as during a turn, there is a danger that the bow will rise and possibly expose the bottom of the hull to sufficient air pressure to cause loss of control or perhaps even make the hull become airborne or flip. To counteract the tendency of the bow to rise in such circumstances, the anti-cavitation plate is pivoted or lowered to apply a countering force on the hull to lower the bow and maintain appropriate control. The mechanism for lowering the anti-cavitation plate under such circumstances is typically a pedal mounted for depression by the driver when the plate is to be lowered.

With high powered boats and high speeds, the force required to lower the anti-cavitation plate can be substantial. The force required at the pedal by the driver can require significant leg strength and, more importantly, become quite fatiguing if the cavitation plate must be maintained in a lowered position for a substantial length of time.

OBJECTS OF THE INVENTION

It is therefore an object of the present invention to provide an anti-cavitation plate system for use on racing boats.

It is also an object of the present invention to provide an anti-cavitation plate system that assists a race boat driver to lower a cavitation plate and maintain the plate at a desired position for extended periods of time.

It is also an object of the present invention to provide an anti-cavitation plate system that maintains the safety of a direct connection between an operating pedal depressed by a driver while permitting assistance in the application of force to operate the cavitation plate.

These and other advantages of the present invention will become apparent to those skilled in the art as the description proceeds.

BRIEF DESCRIPTION OF THE DRAWINGS

The present invention may more readily be described by reference to the accompanying drawings in which.

DETAILED DESCRIPTION OF THE PREFERRED EMBODIMENTS

Figure 1:
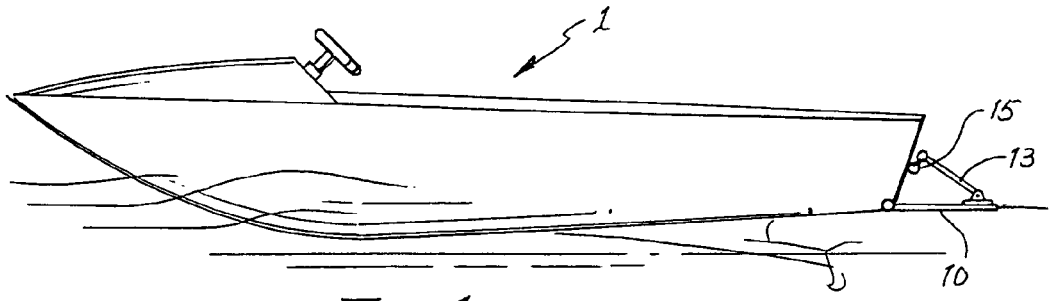
FIG. 1 is a schematic representation of a race boat hull having an anti-cavitation plate secured thereto.

Referring to FIG. 1, a schematic side view of a race boat suitable for using the anti-cavitation system of the present invention is shown. The boat hull 1 incorporates and anti-cavitation plate extending rearwardly at the stern of the boat and positioned basically at water level during boat operation. The anti-cavitation plate is pivoted to lower the plate into the water as the boat proceeds. The plate may be attached to the hull by a hinge or hinges, or may be secured flush to the bottom of the boat at the stern and flexed at the trailing end. The lowering and the raising of the anti-cavitation plate is accomplished by extending a plate actuating arm 13 which in turn is actuated by a control lever 15. As the boat is propelled through the water, an attempt is made by the driver to maintain a predetermined and desirable attitude of the boat hull with respect to the water surface. Under some conditions, such as rough water and the like, the bow of the boat may have a tendency to rise dangerously high and may cause the loss of boat control. To apply a downward force on the bow of the boat, the anti-cavitation plate may be lowered to thus apply a counter force on the hull tending to lower the bow and thus maintain a proper and controllable attitude of the hull in the water.

Figure 2:
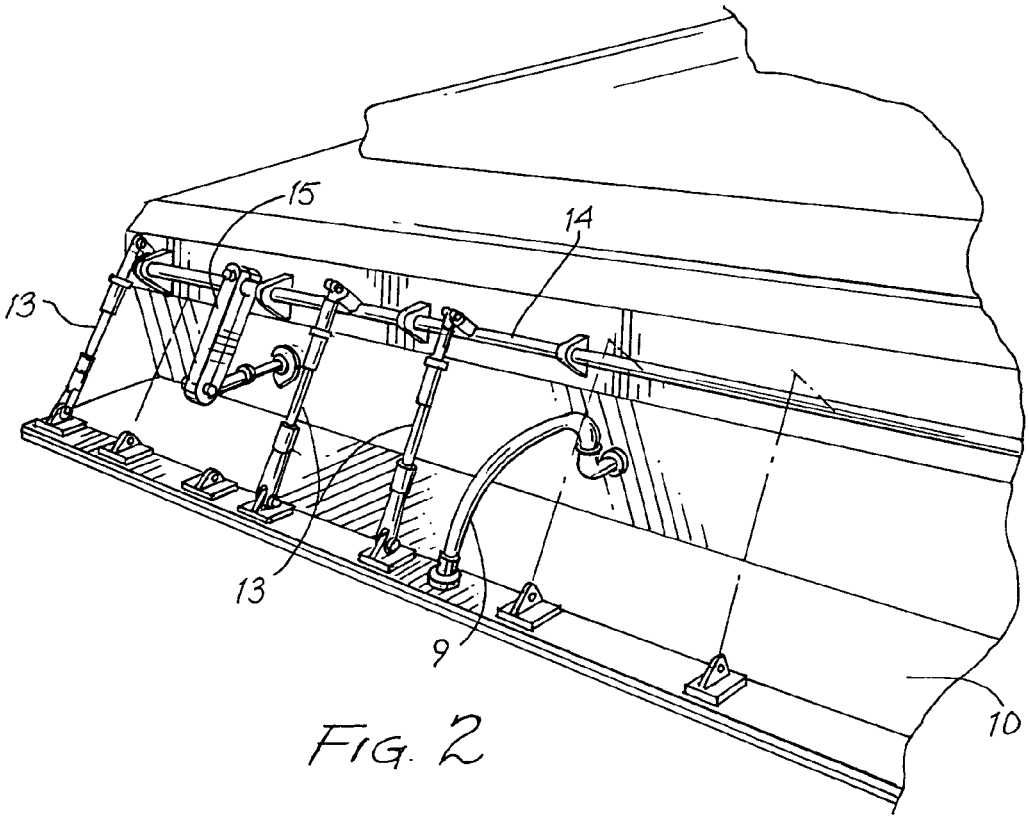
FIG. 2 is a perspective view of the stern of a racing boat showing a typical installation of an anti-cavitation plate.

A typical installation of an anti-cavitation plate system is shown in FIG. 2. The anti-cavitation plate 10 is secured to the stern or the stern end of the bottom of the hull in a manner well known in the art. The anti-cavitation plate 10 is lowered and raised by the extension and retraction of a control level 15 acting through control rod 14 on plate actuating arms 13. The installation of the cavitation plate system shown in FIG. 2 is typical; a water inlet pipe 9 is shown for conducting water into the boat for various purposes such as heat exchangers and the like.

Figure 3:
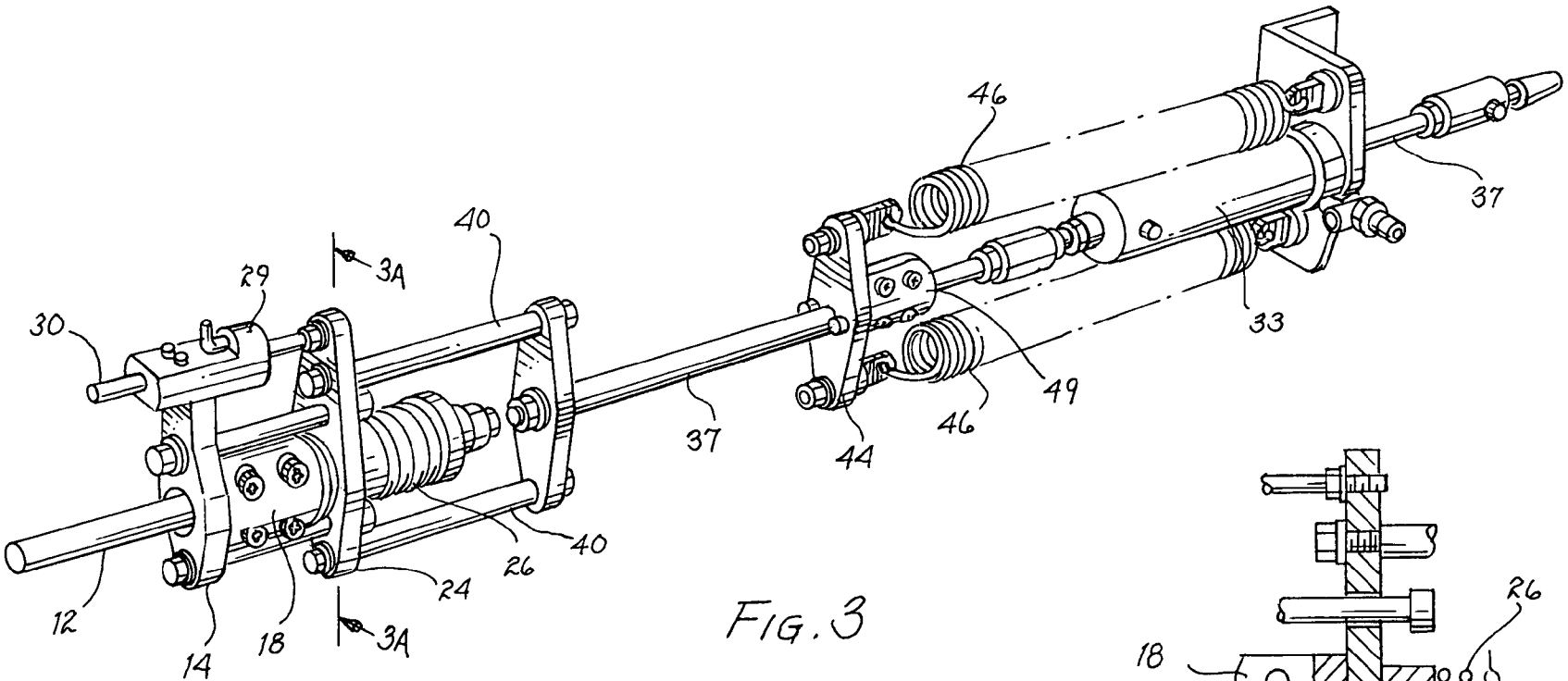
FIG. 3 is a perspective view of a portion of the anti-cavitation plate system of the present invention.
Figure 3A:
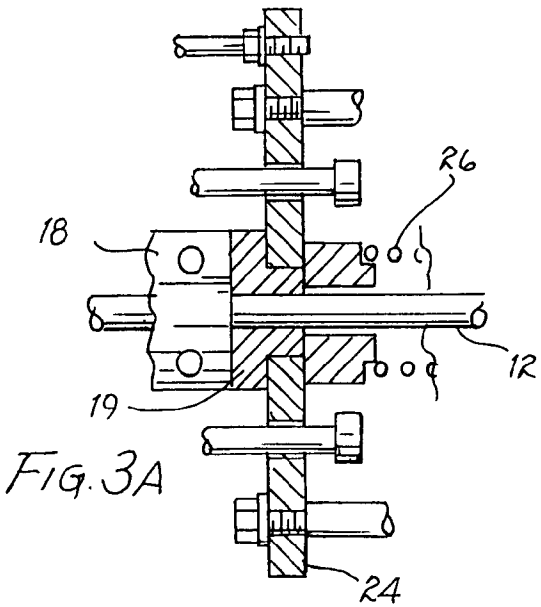
FIG. 3A is a cross-sectional view of a portion of FIG. 3 taken along lines 3A-3A.
Figure 4:
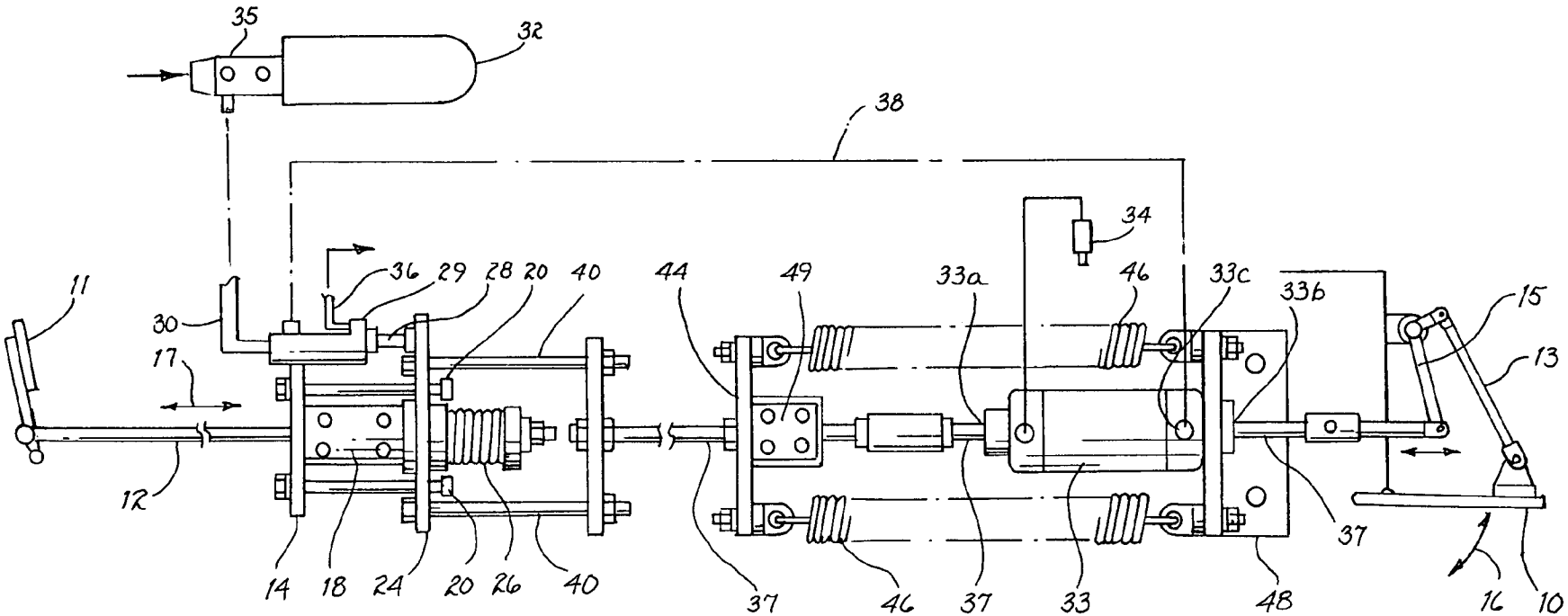
FIG. 4 is a drawing of the anti-cavitation plate system of the present invention.

Referring now to FIGS. 3, 3A and 4, an anti-cavitation plate system constructed in accordance with the teachings of the present invention is shown. The anti-cavitation plate 10 is lowered and raised as indicated by the arrow 16 through forces applied by the plate actuating arm 13 which in turn is activated by the control lever 15. Depressing the control pedal 11 results in the lowering of the cavitation plate 10; similarly, relieving pressure on the control pedal will raise the anti-cavitation plate. The control pedal is connected through a control shaft 12 to an actuating plate 14. The actuating plate 14 is moved to the left as shown in FIG. 4 by the corresponding motion of the control shaft 12. The actuating plate 14 is secured for motion corresponding to the control shaft 12 by the locking collar 18. The control shaft thus imparts the motion of the control shaft 12 as indicated by the arrow 17 to the actuating plate 14. Stop pins 20 are secured to the actuating plate and thus are drawn to the left along with the actuating plate and control shaft. It may be noted that the stop pins 20 may be moved to the left for a short distance until the heads of the stop pins contact the transfer plate 24.

During this initial motion of the actuating plate 14, a pneumatic control valve 29, mounted on the actuating plate 14, also moves to the left along with the plate. A suitable control valve may be acquired from Versa Company, valve style BIK-3207. As the control valve is moved to the left, it is opened by the reduced pressure of the control actuating pin 28 which remains stationary during the initial motion of the control valve 29. When the control valve 29 is opened, regulated pressurized air from pressurized air tank supply 32 is applied through the air pressure regulator 35 to the control valve input 30. The output of the control valve 29, schematically shown in FIG. 4 as a broken line 38 applies the regulated high pressure air to an air assist cylinder 33. Thus, during the initial motion of the control pedal 11, the control shaft and actuating plate have moved to the left as shown in FIG. 4 together with the control valve 29. This initial motion of the panel thus resulted in the application of pressurized air from the pressurized air tank supply 32 to the air cylinder 33. The air cylinder 33 is a readily available commercial pneumatic cylinder having a piston connected to double piston rods 33*a* and 33*b*. These piston rods actually form a continuation of the actuating shaft 37. Regulated pressurized air admitted to the cylinder input 33*c* will move the piston and the opposing piston rods to the left as shown in FIG. 4. The opposite side of the piston is vented to the atmosphere through vent 34. An appropriate cylinder may be acquired from Bimba Company, Model 243-DXDE. The air pressure applied to the cylinder results in a force applied to the actuating shaft 37 that opposes the force exerted by a pair of extension springs 46. The extension springs act as the anti-cavitation plate return springs.

Thus, the initial depression of the control pedal has resulted in the application of pneumatic pressure to the air assist cylinder 33 and the application of force in opposition to the force exerted by the extension springs 46. Pressurized air applied to the cylinder 33 results in force being applied to the actuating shaft 37 to the left in opposition to the force being exerted by the extension springs 46. It is important to note that the force exerted by the air assist cylinder 33 is not sufficient to extend the extension spring; rather, the force merely applies a pre-load in opposition to the extension spring so that a predetermined but modest additional force supplied by the operator through the control pedal 11 will cause movement of the actuating shaft and thus downward movement of the anti-cavitation plate 10. The anti-cavitation plate 10 remains in the horizontal position as shown in FIG. 4 during this initial operation or actuation of the control pedal. Further depression of the control pedal will result in the heads of the stop pins 20 contacting the transfer plate 24 that will transfer any additional motion of the control shaft to the anti-cavitation plate actuating shaft 37 through the coupling pins or bolts 40. Continued depression of the control pedal 11 will thus result in motion of the anti-cavitation plate actuating shaft 37 to the left as shown in FIG. 4 and will result in the extension of the extension springs 46 combined with the motion of the control lever 15, plate actuating arm 13 and anti-cavitation plate 10. Thus continued depression of the control pedal 11 will result in the lowering of the anti-cavitation plate; the further the control pedal is depressed, the further the cavitation plate is lowered. When the pressure applied to the control pedal is removed, the compression spring 26 will expand causing the actuating plate 14 and the control valve 29 mounted thereon to return to the position shown in FIG. 4 wherein the control valve actuating pin 28 deactivates the control valve shutting off the control valve input 30 and exhausting the pressurized air in the system through exhaust port 36. The extension springs 46 apply return force by contracting and move the actuating shaft 37 to the right as shown in FIG. 4 to cause the anti-cavitation plate 10 to rise.

The extension springs 46 may be anchored at one end by a spring mounting bracket 48 that is appropriately secured to the boat such as by attachment to a stringer. A vent 34 is provided to permit the exhaust of air displaced by the piston within the air assist cylinder 33. The extension springs 46, which may be referred to as return springs, are attached to an extension spring bracket 44 that is secured to the anti-cavitation plate actuation plate 37 through the utilization of a locking collar 49. The collar 49 may be used to adjust the position of the actuating shaft 37. Similarly, locking collar 18 is used to secure the operation of the actuating plate 14 with the control shaft 12. It should be noted that while extension springs are shown in the chosen embodiment, the mounting arrangement could be modified to use compression springs. Similarly, the extension/return springs could be single springs and could be directly connected to the anti-cavitation plate rather than connected to the actuation shaft.

Referring specifically to FIG. 3A, the transfer plate 24 is shown in section showing the control shaft 12 extending therethrough. The compression spring 26 surrounds the control shaft 12; the shaft is maintained centralized through the opening provided in the transfer plate 24 by a collar 19 which may be formed of a suitable plastic material such as Delrin® that slightly engages the control shaft 12 and maintains the latter appropriately centered.

The present invention has been described in terms of selected specific embodiments of the invention incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed is:

1. An anti-cavitation plate system comprising:

(a) an anti-cavitation plate secured at the stern of a boat;

(b) an actuating shaft connected to said anti-cavitation plate for lowering and raising the anti-cavitation plate;

(c) a return spring connected to said plate to apply a given force to maintain the plate substantially horizontal;

(d) a driver operated pedal connected to the actuating shaft, the pedal, when depressed by the driver, lowering the anti-cavitation plate against the force exerted by said return spring; and (e) a pneumatic cylinder having a piston connected to said actuating shaft responsive to the application of pneumatic pressure thereto for applying a force opposite to and less than said given force.

2. The anti-cavitation plate system of claim 1 wherein said return spring is an extension spring.

3. An anti-cavitation plate system comprising:

(a) an anti-cavitation plate secured at the stern of a boat;

(b) an actuating shaft connected to said anti-cavitation plate for lowering and raising the anti-cavitation plate;

(c) a return spring connected to said plate to apply a given force to maintain the plate substantially horizontal;

(d) a driver operated pedal connected to the actuating shaft, the pedal, when depressed by the driver, lowering the anti-cavitation plate against the force exerted by said return spring;

(e) a regulated pneumatic pressure supply;

(f) a control valve responsive to operation of the pedal for admitting regulated pressure to a pneumatic cylinder;

(g) a pneumatic cylinder having a piston rod connected to said actuating shaft, and pneumatically connected through said control valve to the pneumatic pressure supply; and (h) the regulated pressure chosen to provide a force exerted by said piston on said actuating shaft opposing but less than said given force.

4. The anti-cavitation plate system of claim 3 wherein said return spring is an extension spring.

5. An anti-cavitation plate system comprising:

(a) an anti-cavitation plate secured at the stern of a boat;

(b) an actuating shaft connected to said anti-cavitation plate for lowering and raising the anti-cavitation plate;

(c) a return spring connected to said actuating shaft to apply a given force to maintain the plate substantially horizontal;

(d) a driver operated pedal connected to the actuating shaft, the pedal, when depressed by the driver, lowering the anti-cavitation plate against the force exerted by said return spring; and (e) a pneumatic cylinder having a piston connected to said actuating shaft responsive to the application of pneumatic pressure thereto for applying a force opposite to and less than said given force.

6. The anti-cavitation plate system of claim 5 wherein said return spring is an extension spring.

7. In a boat having a moveable anti-cavitation plate mounted at the stern thereof, and having a driver operated pedal connected to said plate for lowering said plate, the improvement comprising:

(a) a regulated pneumatic pressure supply;

(b) a pneumatic cylinder having a piston and having a piston rod connected to said plate; and (c) a control valve connected to said pedal and responsive to driver operation of said pedal to admit regulated pneumatic pressure from said pressure supply to said pneumatic cylinder to assist the driver to lower the plate.

8. The improvement set forth in claim 7 wherein said pedal is connected to said plate through said piston rod.

9. The improvement set forth in claim 7 wherein said anti-cavitation plate is maintained in a substantially horizontal position by a return spring and said piston exerts a force in opposition to the return spring.

10. The improvement set forth in claim 7 wherein said anti-cavitation plate is maintained in a substantially horizontal position by a return spring and said piston exerts a force in opposition to the return spring and wherein the force exerted by the return spring is greater than the force exerted by the piston but less than the force exerted by both the piston and the driver operated pedal.

* * * * *